US008435377B1

(12) United States Patent
Greenhalgh

(10) Patent No.: US 8,435,377 B1
(45) Date of Patent: May 7, 2013

(54) DRYWALL TAPE DISPENSER ASSEMBLY

(76) Inventor: Rodney K. Greenhalgh, Challis, ID (US)

( * ) Notice: Subject to any disclaimer, the term of this patent is extended or adjusted under 35 U.S.C. 154(b) by 305 days.

(21) Appl. No.: 12/802,478

(22) Filed: Jun. 8, 2010

Related U.S. Application Data

(60) Provisional application No. 61/268,164, filed on Jun. 9, 2009.

(51) Int. Cl.

| | |
|---|---|
| ***B29C 65/00*** | (2006.01) |
| ***B32B 27/00*** | (2006.01) |
| ***B32B 37/00*** | (2006.01) |
| ***B44C 7/00*** | (2006.01) |
| ***E04D 15/00*** | (2006.01) |
| ***E04B 2/00*** | (2006.01) |

(52) U.S. Cl.
USPC ..... 156/278; 156/574; 52/417

(58) Field of Classification Search ..... 156/278, 156/574; 52/417
See application file for complete search history.

(56) References Cited

U.S. PATENT DOCUMENTS

| | | | | |
|---|---|---|---|---|
| 3,669,070 | A * | 6/1972 | Wallace | 118/102 |
| 5,736,001 | A | 4/1998 | Samuelson | |
| D466,384 | S | 12/2002 | Dillinger et al. | |
| 6,540,856 | B2 | 4/2003 | O'Mara et al. | |
| 2006/0179753 | A1 * | 8/2006 | Teel | 52/417 |

* cited by examiner

*Primary Examiner* — Michael Orlando
(74) *Attorney, Agent, or Firm* — Emery L Tracy

(57) ABSTRACT

A drywall tape dispenser assembly for dispensing joint tape and joint compound used in finishing joints in sheetrock or drywall is provided. The drywall tape dispenser assembly comprises a main body having a first side wall, a second side wall, a bottom wall, a front wall, and a rear wall, with the first side wall, the second side wall, the bottom wall, the front wall, and the rear wall creating a mud receiving area. A first slot is formed between the front wall and the bottom wall and a second slot formed between the rear wall and the bottom wall. A tape dispensing mechanism dispenses the tape into and out of the mud receiving area wherein an amount of joint compound is placed in the mud receiving area over a portion of the joint tape within the mud receiving area and wherein a desired amount of joint tape is pulled through second slot, through the joint compound in the mud receiving area, and out of the first slot with a coating of joint compound thereon.

3 Claims, 1 Drawing Sheet

DRYWALL TAPE DISPENSER ASSEMBLY

The present application claims the benefit of priority of pending provisional patent application Ser. No. 61/268,164, filed on Jun. 9, 2009, entitled "Drywall Taper Box".

BACKGROUND OF THE INVENTION

1. Field of the Invention

This invention relates generally to a drywall tape dispenser assembly and, more particularly, the invention relates to a drywall tape dispenser assembly creating a more effective tool for finishing the joints in sheetrock or drywall.

2. Description of the Prior Art

The interiors of most buildings today, both commercial and residential, are generally finished with sheetrock. Also known as drywall, wallboard, or gypsum board, sheetrock consists of the pressed mineral gypsum sandwiched between two layers of paper. The material is sold in 4×8, 4 by 9, and 4 by 10 foot sheets; the most common thicknesses are ½ inch and ⅝ inch (though other thicknesses are available).

Drywall panels are fastened directly to wall studs or to furring strips applied over masonry surfaces, using wallboard nails, wallboard screws, or, in some cases, adhesive. The joints between panels are hidden by wallboard joint compound and joint tape. In some cases, a texture of special topping compound is applied over the entire surface. In finishing the joints, the joint tape is applied over the joint compound, or "mud". A need exists for allowing a drywall installer to more effectively coordinate the application of joint compound and joint tape, by incorporating the compound and the tape in a single dispenser.

SUMMARY

The present invention is a drywall tape dispenser assembly for dispensing joint tape and joint compound used in finishing joints in sheetrock or drywall. The drywall tape dispenser assembly comprises a main body having a first side wall, a second side wall, a bottom wall, a front wall, and a rear wall, with the first side wall, the second side wall, the bottom wall, the front wall, and the rear wall creating a mud receiving area. A first slot is formed between the front wall and the bottom wall and a second slot formed between the rear wall and the bottom wall. A tape dispensing mechanism dispenses the tape into and out of the mud receiving area wherein an amount of joint compound is placed in the mud receiving area over a portion of the joint tape within the mud receiving area and wherein a desired amount of joint tape is pulled through second slot, through the joint compound in the mud receiving area, and out of the first slot with a coating of joint compound thereon.

In addition, the present invention includes a method for dispensing joint tape and joint compound used in finishing joints in sheetrock or drywall. The method comprises providing a main body having a first side wall, a second side wall, a bottom wall, a front wall, and a rear wall, creating a mud receiving area from the first side wall, the second side wall, the bottom wall, the front wall, and the rear wall, forming a first slot between the front wall and the bottom wall, forming a second slot between the rear wall and the bottom wall, placing an amount of joint compound placed in the mud receiving area over a portion of the joint tape within the mud receiving area, and pulling a desired amount of joint tape through second slot, through the joint compound in the mud receiving area, and out of the first slot with a coating of joint compound thereon.

The present invention further includes a drywall tape dispenser assembly for dispensing joint tape and joint compound used in finishing joints in sheetrock or drywall. The drywall tape dispenser assembly comprises a main body having a first side wall, a second side wall, a bottom wall, a front wall, and a rear wall, with the first side wall, the second side wall, the bottom wall, the front wall, and the rear wall creating a mud receiving area. A first slot is formed between the front wall and the bottom wall and a second slot formed between the rear wall and the bottom wall. A first strut extends from the first wall with the first strut angling in a generally upward direction and a second strut extends from the second wall with the second strut angling in a generally upward direction. A center axle is releasably positioned between the first strut and the second strut, the center axle holding a roll of joint tape wherein the joint tape is dispensed from the center axle, through the second slot, through the mud receiving area, and through the first slot, wherein an amount of joint compound is placed in the mud receiving area over a portion of the joint tape within the mud receiving area, and wherein a desired amount of joint tape is pulled through second slot, through the joint compound in the mud receiving area, and out of the first slot with a coating of joint compound thereon.

DETAILED DESCRIPTION OF THE PREFERRED EMBODIMENTS

Figure 3:
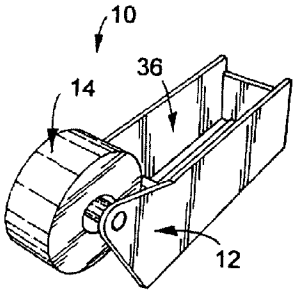
FIG. 3 is a rear perspective view illustrating the drywall tape dispenser assembly, constructed in accordance with the present invention.
Figure 2:
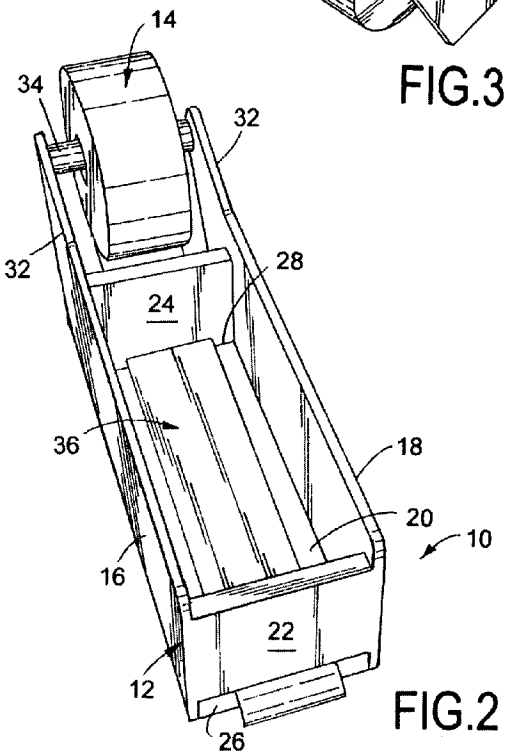
FIG. 2 is a top perspective view illustrating the drywall tape dispenser assembly, constructed in accordance with the present invention.
Figure 1:
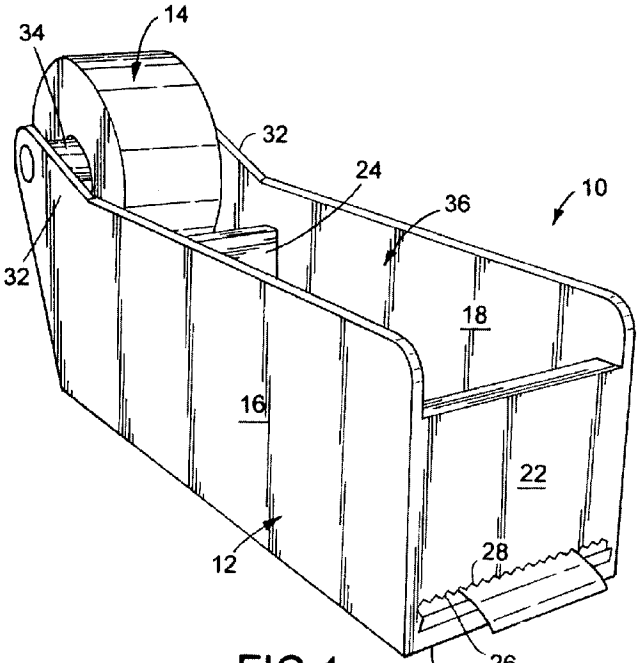
FIG. 1 is a front perspective view illustrating a drywall tape dispenser assembly, constructed in accordance with the present invention.

As illustrated in FIGS. 1-3, the present invention is a drywall tape dispenser assembly, indicated generally at 10, for creating a more effective tool for finishing the joints in sheetrock or drywall. The drywall tape dispenser assembly 10 of the present invention is a dispenser 12 accommodating both a roll of joint tape 14 and a quantity of joint compound, such that the joint tape 14 is "mudded" in the process of being pulled through the dispenser 12.

The dispenser 12 of the drywall tape dispenser assembly 10 of the present invention is preferably constructed of a durable lightweight metal, injection-molded thermoplastic, or disposable, heavy cardboard. The dispenser 12 of the drywall tape dispenser assembly 10 preferably measures approximately fourteen (14") inches in length and approximately four (4") inches in height. It should be noted that while the dispenser 12 of the drywall tape dispenser assembly 10 is described and illustrated herein as being constructed of specific materials and having a specific size, it is within the scope of the present invention to construct the dispenser 12 of the drywall tape dispenser assembly 10 from any type of durable material and to construct the drywall tape dispenser assembly 10 of any size.

As stated above, the drywall tape dispenser assembly 10 of the present invention has the dispenser 12 for holding a roll of joint tape 14 and an amount of joint compound, i.e., drywall mud. The dispenser 12 has a first side wall 16, a second side wall 18 opposite and substantially parallel to the first side wall 16, a bottom wall 20 substantially perpendicular to and between the first side wall 16 and the second side wall 18, a front wall 22 substantially perpendicular to and between the first side wall 16 and the second side wall 18, and a rear wall 24 substantially opposite the front wall 22 and substantially perpendicular to and between the first side wall 16 and the second side wall 18. A first slot 26 is formed between the front wall 22 and the bottom wall 20 and a second slot 28 is formed between the rear wall 24 and the bottom wall 20. A plurality of teeth or serrations 30 can be added to the first slot 26 to assist the user in tearing a desired amount of tape from the tape roll 14, as will be discussed further below.

The drywall tape dispenser assembly 10 of the present invention has two substantially parallel, angled struts 32 extending from the first side wall 16 and the second side wall 18, respectively beyond the rear wall 24. Preferably, the struts 32 are set at an angle of approximately thirty (30°) degrees such that an end point of the struts 32 is positioned above the first side wall 16 and the second side wall 18. Spanning the area between the struts 32 nearingly adjacent the end of the struts 32 is a center axle 34. The center axle 34 runs through the center hub of a roll of joint tape 14 and can be removed to remove a used roll of joint tape 14 and to install a new roll of joint tape 14.

The first side wall 16, the second side wall 18, the bottom wall 20, the front wall 22, and the rear wall 24 of the drywall tape dispenser assembly 10 of the present invention create a mud receiving area 36 for receiving the quantity of joint compound. In practice, the joint tape 14 is rolled off the roll of joint tape 14 through the second slot 28, through the joint compound, and out the first slot 26. The size of the first slot 26 allows excess joint compound to be taken off the joint tape 14 as the joint tape 14 exits the dispenser 12 through the first slot 26.

The manner of use of the drywall tape dispenser assembly 10 of the present invention will now be described. It will be understood by those skilled in the art that the manner of use of the drywall tape dispenser assembly 10 described herein is merely one method of use and other methods of use of the drywall tape dispenser assembly 10 are within the scope of the present invention.

Use of the drywall tape dispenser assembly 10 of the present invention is very simple and straightforward. First, the joint tape 14 is pulled from the roll of joint tape 14, through the second slot 28 at the far end of the dispenser 12, and out the first slot 26. The mud receiving area 36 is filled with a desired quantity of joint compound, such that the joint compound is on top of the joint tape 14. As the joint tape 14 is pulled out of the dispenser 12, such as applying the joint tape to an unfinished wall, the joint tape 14 is impregnated with a smooth and even coating of joint compound, and joint tape 14 and joint compound can be applied to the unfinished drywall joint.

The drywall tape dispenser assembly 10 of the present invention presents a number of distinct and significant benefits and advantages. Foremost, the drywall tape dispenser assembly 10 allows drywall installers to save time and energy in finishing drywall joints, and to do so with less waste and mess. With the drywall tape dispenser assembly 10, the joint tape 14 is impregnated with a smooth and even coating of joint compound as it comes out of the dispenser 12 so that the joint tape 14 and joint compound are ready for immediate application to the drywall joint. With the drywall tape dispenser assembly 10, the application is smooth and efficient, and the smoother the application of joint tape 14 and joint compound, the less sanding required later.

An innovative and clever time-saver, the drywall tape dispenser assembly 10 of the present invention will be particularly appreciated by the amateur do-it-yourself homeowner, whose skills are not those of a professional drywall installer. For the amateur, the drywall tape dispenser assembly 10 puts the joint tape 14 and the joint compound together in an easily handled dispenser 12, and thus makes a difficult job easier, but also smoother, quicker, more efficient and cleaner. A handheld device for applying drywall tape 14 and taping compound to seams in drywall, the drywall tape dispenser assembly 10 of the present invention enables a drywall installer, whether professional or amateur, to apply both joint tape 14 and joint compound in one easy operation.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A drywall tape dispenser assembly for dispensing joint tape and joint compound used in finishing joints in sheetrock or drywall, the drywall tape dispenser assembly comprising:

a main body having a first side wall, a second side wall, a bottom wall, a front wall, and a rear wall, the first side wall, the second side wall, the bottom wall, the front wall, and the rear wall creating a mud receiving area;

a first slot formed between the front wall and the bottom wall;

a second slot formed between the rear wall and the bottom wall;

a first strut extending from the first side wall, the first strut angling in a generally upward direction, the first strut connected only to the first side wall:

a second strut extending from the second side wall, the second strut angling in a generally upward direction, the second strut connected only to the second side wall; and a non-pivoting, fixed center axle releasably positioned between the first strut and the second strut, the center axle holding a roll of joint tape;

wherein the joint tape is dispensed from the center axle, through the second slot, through the mud receiving area, and through the first slot;

wherein the center axle always being positioned above a top edge of the first side wall and the second side wall during dispensing of the joint tape regardless of the amount of joint positioned about the center axle;

wherein an amount of joint compound is placed in the mud receiving area over a portion of the joint tape within the mud receiving area; and wherein a desired amount of joint tape is pulled through second slot, through the joint compound in the mud receiving area, and out of the first slot with a coating of joint compound thereon.

2. The drywall tape dispenser assembly of claim 1 wherein the angle of each of the struts is approximately thirty (30°) degrees.

3. The drywall tape dispenser assembly of claim 1 and further comprising:

a plurality of teeth along the first slot.

* * * * *